US007935029B2

(12) United States Patent
Hector

(10) Patent No.: US 7,935,029 B2
(45) Date of Patent: May 3, 2011

(54) SWIMMER TRAINING APPARATUS HAVING FORCE CONTROL

(75) Inventor: Dwight Hector, Ellettsville, IN (US)

(73) Assignee: Hector Engineering Co, Inc., Ellettsville, IN (US)

( * ) Notice: Subject to any disclaimer, the term of this patent is extended or adjusted under 35 U.S.C. 154(b) by 87 days.

(21) Appl. No.: 12/322,271

(22) Filed: Jan. 30, 2009

(65) Prior Publication Data

US 2010/0197467 A1 Aug. 5, 2010

(51) Int. Cl.
*A63B 31/00* (2006.01)

(52) U.S. Cl. ..... 482/55; 482/903

(58) Field of Classification Search ..... 482/1, 2, 482/3, 4, 5, 6, 7, 8, 9, 55, 56, 92, 901, 903; 318/539, 558, 701; 434/247, 254; 242/381; 441/55

See application file for complete search history.

(56) References Cited

U.S. PATENT DOCUMENTS 3,848,467 A * 11/1974 Flavell ..... 482/4
4,114,874 A 9/1978 Mattila
4,261,562 A * 4/1981 Flavell ..... 482/6
4,529,196 A * 7/1985 Logan et al. ..... 482/92
4,678,184 A * 7/1987 Neiger et al. ..... 482/4
4,869,497 A 9/1989 Stewart et al.
5,301,894 A 4/1994 Imai
5,318,491 A 6/1994 Houston
5,334,027 A 8/1994 Wherlock
5,391,080 A 2/1995 Bernacki et al.
5,538,486 A 7/1996 France et al.
5,813,945 A 9/1998 Bernacki
6,168,107 B1 * 1/2001 Bishop et al. ..... 242/381
6,310,416 B1 * 10/2001 Chang ..... 310/105
6,620,043 B1 9/2003 Haseltine et al.
7,113,166 B1 9/2006 Rosenberg et al.
7,381,161 B2 6/2008 Ellis
2007/0057112 A1 * 3/2007 Brum ..... 244/1 TD

* cited by examiner

*Primary Examiner* — Loan Thanh
*Assistant Examiner* — Tam Nguyen
(74) *Attorney, Agent, or Firm* — Liell & McNeil

(57) ABSTRACT

A swimmer training apparatus includes a housing having a rotatable spool mounted therein and defining a longitudinal spool axis. The rotatable spool includes a cylindrical outer surface and a spooler is mounted to the housing and adapted to axially advance a swimmer tethering line along the cylindrical outer surface during playing out or taking up the swimmer tethering line. The swimmer training apparatus further includes a torque transfer device coupled between a motor and the rotatable spool and including a magnetic field generator configured to generate a magnetic field. The torque transfer device further includes a rotatable mechanism fixed to rotate with the rotatable spool and a rotatable mechanism fixed to rotate with the motor. One of the rotatable mechanisms includes a magnetically permeable medium adapted via interacting with the magnetic field to transfer a torque between the first rotatable mechanism and the second rotatable mechanism during rotating the rotatable spool. A torque control system for the swimmer training apparatus includes an electronic control unit configured via software and/or hardware control to implement an operating method for training or evaluating performance of a swimmer.

18 Claims, 5 Drawing Sheets

SWIMMER TRAINING APPARATUS HAVING FORCE CONTROL

TECHNICAL FIELD

The present disclosure relates generally to systems for athletic training, instruction or evaluation of a swimmer in a swimming pool, and relates more particularly to a swimmer training apparatus and strategy where a controllable assistive or resistive force is applied to a swimmer tethering line.

BACKGROUND

A variety of swimmer training devices are known and have been widely used for many years. Certain early system utilized vertically movable weight stacks or elastic mechanisms tethered to a swimmer to provide a resistive force as the swimmer swims one direction in a swimming lane, and/or to provide assistive forces as the swimmer swims the other direction in the swimming lane. It has been recognized for some time that performance of swimming athletes can be enhanced by specialized training regimens using the resistive or assistive mechanisms described above. Conventional systems, however, long suffered from a variety of drawbacks, including expense, complexity and inapplicability to certain desired training regimens.

In an attempt to introduce automation and computer control and monitoring to swimming training, as had been done earlier in certain other sports, in recent years manufacturers proposed a variety of mechanisms where a swimmer tethering line is spooled or unspooled about a rotatable mechanism. The speed of rotation of the rotatable mechanism could be controlled, and in certain instances brakes were selectively applied to the rotatable mechanism to apply a frictional drag. These systems generally improved over elastic bands, weight stacks and the like in terms of controllability and applicability to different training regimens. However, many swimmers and swimming trainers have viewed such systems unfavorably from a performance standpoint as well as expense, reliability and general feel. On the one hand, swimming against a frictional drag or a varying speed of the rotatable mechanism may impart a perceived unnatural feel. Moreover, applying a frictional drag does not always provide an easy mechanism for gathering and processing data associated with a swimmer's performance. Further, while electric motors may have a controllable speed, they typically do not provide a variable force, at least without also varying speed. Further still, existing systems lack any mechanism for readily determining power output or peak power output of a swimmer, factors suggested as useful by swimmer training research.

U.S. Pat. No. 5,391,080 to Bernacki et al. proposes a swim instruction, training and assessment apparatus. Bernacki et al. is representative of one class of swimmer training systems that, while improving over various earlier strategies, suffer from certain of the drawbacks discussed above. Namely, Bernacki et al. does not provide for smooth controllability of resistive or assistive forces applied to a swimmer, and does not allow for easy determination of power output or peak power output of a swimmer.

The present disclosure is directed in part to one or more of the problems or shortcomings set forth above.

SUMMARY

In one aspect, a swimmer training apparatus includes a housing and a rotatable spool mounted to the housing and defining a longitudinal spool axis. The rotatable spool includes a cylindrical outer spool surface and is configured via rotating in a first direction or a second direction opposed to the first direction for respectively playing out or taking up a swimmer tethering line. The swimmer training apparatus further includes a spooler mounted to the housing and adapted to axially advance a swimmer tethering line along the cylindrical outer spool surface during playing out or taking up the swimmer tethering line. The swimmer training apparatus further includes a motor mounted within the housing and including a motor output shaft, and a torque transfer device coupled between the motor output shaft and the rotatable spool. The torque transfer device includes a magnetic field generator configured to generate a magnetic field, a first rotatable mechanism fixed to rotate with the motor output shaft and a second rotatable mechanism fixed to rotate with the rotatable spool. One of the first rotatable mechanism and the second rotatable mechanism includes a magnetically permeable medium adapted via interacting with the magnetic field to transfer a torque between the first rotatable mechanism and the second rotatable mechanism during rotating the rotatable spool.

In another aspect, a method of operating a swimmer training apparatus includes applying a torque to a rotatable spool of the swimmer training apparatus via a torque transfer device having a first rotatable mechanism fixed to rotate with a motor for rotating the rotatable spool and a second rotatable mechanism fixed to rotate with the rotatable spool. The rotatable spool is configured for playing out or taking up a swimmer tethering line via spooling the swimmer tethering line on a cylindrical outer spool surface thereof. The method further includes changing an electrical energy state of the torque transfer device, and applying a different torque to the rotatable spool responsive to changing the electrical energy state of the torque transfer device.

In still another aspect, a torque control system for a swimmer training apparatus includes a torque transfer device having an electrically powered magnetic field generator, a first rotatable mechanism configured to couple with a motor output shaft of a motor for rotating a rotatable spool adapted for playing out or taking up a swimmer tethering line, and a second rotatable mechanism configured to couple with the rotatable spool. One of the first rotatable mechanism and the second rotatable mechanism includes a magnetically permeable medium adapted via interacting with the magnetic field to transfer torque between the first rotatable mechanism and the second rotatable mechanism during rotating the rotatable spool. The torque control system further includes a sensor configured to monitor at least one of, a swimming distance parameter or a swimming speed parameter, during playing out or taking up the swimmer tethering line via rotating the rotatable spool, and a control system for controlling torque transfer between the first rotatable mechanism and the second rotatable mechanism during playing out or taking up the swimmer tethering line. The control system includes an electronic control unit coupled with the sensing system and in control communication with the magnetic field generator. The electronic control unit is configured to vary a torque transfer between the first rotatable mechanism and the second rotatable mechanism at least in part via controlling an intensity of the magnetic field responsive to inputs from the sensing system.

DETAILED DESCRIPTION

Figure 1:
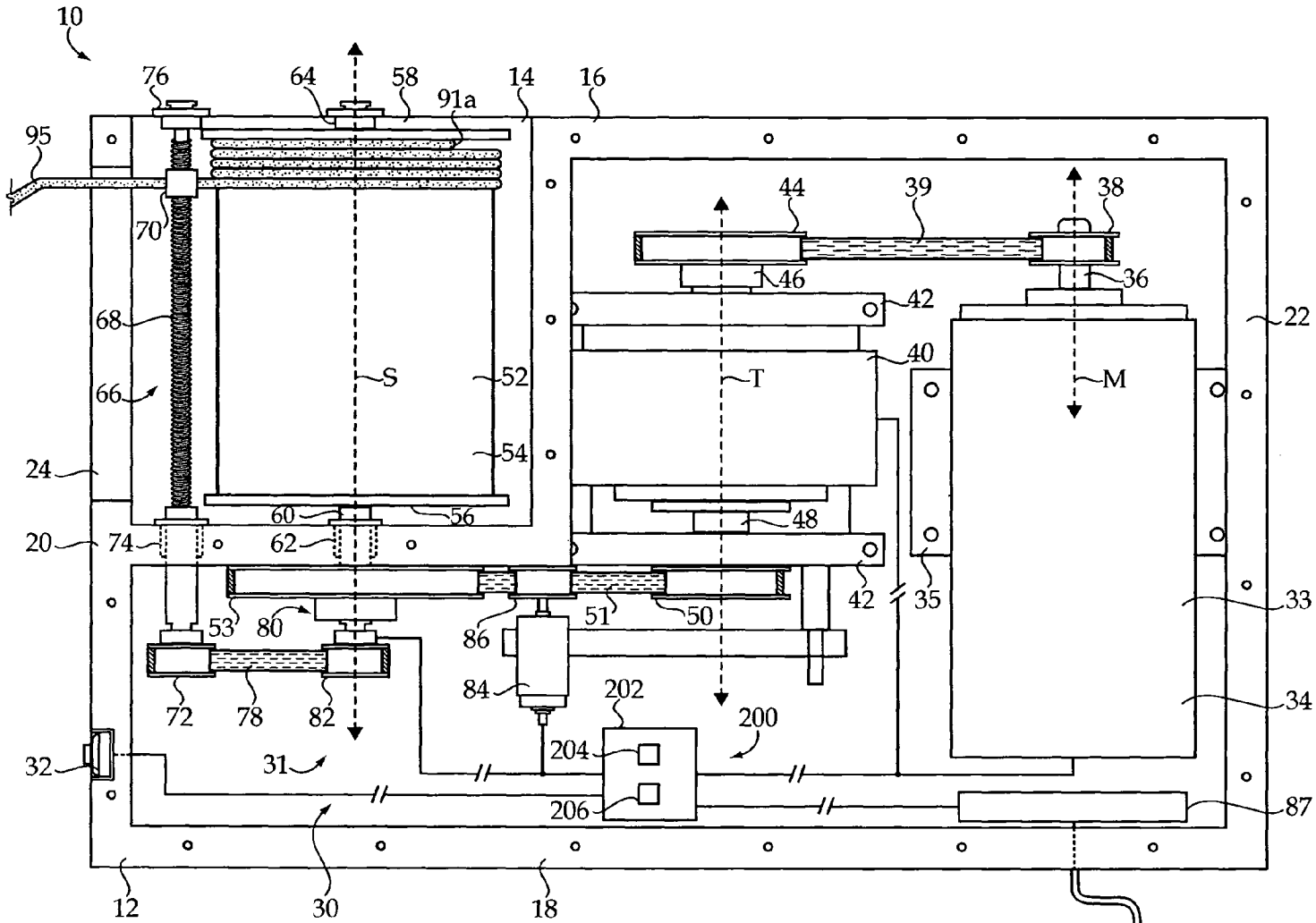
FIG. 1 is a diagrammatic view of a swimmer training apparatus, according to one embodiment.

Referring to FIG. 1, there is shown a diagrammatic view of a swimmer training apparatus 10 according to one embodiment. Swimmer training apparatus 10 includes a housing 12 having a plurality of housing panels, including a bottom housing panel 14, a first side housing panel 16, a second side housing panel 18, a front housing panel 20 and a back housing panel 22. A top housing panel (not shown) may be employed to enclose various internal components of swimmer training apparatus 10 within housing 12 for protection from water, debris, damage, etc. Swimmer training apparatus 10 may include a power system 30 positioned at least partially within housing 12 and configured to apply force to a swimmer during training or performance evaluation in a swimming pool. As will be further apparent from the following description, swimmer training apparatus 10 may be uniquely configured via hardware and/or control software of power system 30 to enable a variable assistive or resistive force to be applied to a swimmer during swimming in a swimming pool.

Power system 30 may include a motor 34 such as a permanent magnet or inductance electric motor positioned within housing 12. Motor 34 may include a motor housing 33 and a rotatable motor output shaft 36. Various internal components such as a stator, rotor, bearings, wiring harness, etc., may be positioned within motor housing 33, but are omitted from the present description as they are deemed familiar to those skilled in the art. Motor 34 may be mounted to bottom housing panel 14 by way of a motor mount 35 in one embodiment. Bottom housing panel 14 may have a substantially planar orientation and thus will be understood to define a horizontal plane. Motor 34 may define a motor axis "M" having an orientation parallel to the horizontal plane defined by bottom housing panel 14. A pulley wheel 38 may be fixedly mounted on motor output shaft 36. While an electric motor provides one practical implementation strategy, it should be appreciated that in other embodiments alternative motor types such as a hydraulic motor or a pneumatic motor might be used.

A rotatable spool 52 may be mounted to housing 12, and in the embodiment shown is positioned within housing 12. Rotatable spool 52 may include a first axial spool end 56 and a second axial spool end 58, and defines a longitudinal spool axis "S". Spool 52 may be mounted such that longitudinal spool axis S is oriented generally parallel bottom housing panel 14. Spool 52 may further include a spool shaft 60 mounted in housing 12 and rotatably journaled via a first bearing 62 proximate first axial spool end 56 and via a second bearing 64 proximate second axial spool end 58. Spool 52 may further include a cylindrical outer spool surface 54. A flexible swimmer tethering line or cord 95 may include a first end 91*a* attached to spool 52. Line 95 may be unwrapped or "unspooled" from cylindrical outer spool surface 54 when rotating spool 52 in a first direction for playing out swimmer tethering line 95, as further described herein. Line 95 may be wrapped or "spooled" onto cylindrical outer spool surface 54 when rotating spool 52 in a second direction opposed to the first direction for taking up swimmer tethering line 95, as further described herein.

A spooler 66 may be mounted to housing 12 adjacent spool 52 and is adapted to axially advance swimmer tethering line 95 along cylindrical outer spool surface 54 during playing out or taking up swimmer tethering line 95. Spooler 66 may include a spooler rod 68 rotatably journaled in housing 12 via a first bearing 74 and via a second bearing 76. A shuttle 70 may be positioned on spooler rod 68 and movable in a direction parallel longitudinal spool axis S to assist in spooling or unspooling swimmer tethering line 95 about cylindrical outer surface 54 in a manner which will be familiar to those skilled in the art. To this end, shuttle 70 may be internally threaded and spooler rod 68 may be externally threaded. Other spooler mechanisms might be used without departing from the scope of the present disclosure. It may be noted from FIG. 1 that front housing panel 20 is viewed edge-on, and may have a generally vertical orientation relative to bottom housing panel 14 in one embodiment. Front housing panel 20 may define a feed opening 24 for feeding/directing swimmer tethering line 95 during spooling or unspooling swimmer tethering line 95. A pulley wheel 72 may be fixedly mounted to spooler rod 68 in one embodiment and configured to rotate spooler rod 68 to enable axially advancing shuttle 70 and thus axially advancing swimmer tethering line 95 on cylindrical outer surface 54. In one embodiment, pulley wheel 72 may be rotated via an endless belt or chain 78, extending about pulley wheel 72 and also extending about another pulley wheel 82 which is fixedly mounted to and rotatable with spool shaft 60.

System 30 may further include a torque transfer device 40 coupled between motor output shaft 36 and spool 52. Torque transfer device 40 may include a housing 41, a first rotatable mechanism 46 fixed to rotate with motor output shaft 36 and a second rotatable mechanism 48 fixed to rotate with spool 52. Torque transfer device 40 may further include a set of mounts 42 mounting torque transfer device 40 to bottom housing panel 14 such that a longitudinal torque transfer device axis "T" defined by torque transfer device 40 is oriented generally parallel bottom housing panel 14. It may be noted from FIG. 1 that longitudinal motor axis M, longitudinal torque transfer device axis T and longitudinal spool axis S are each parallel and non-colinear with one another, and are each oriented generally parallel the horizontal plane defined by bottom housing panel 14. In other embodiments, an in-line configuration for axes M, T and S might be used. Gear trains or the like might also be used to rotatably couple together the various components described herein.

In one embodiment, torque transfer device 40 may include a pulley wheel 44 which is fixedly mounted to first rotatable mechanism 46, and another pulley wheel 50 which is fixedly mounted to second rotatable mechanism 48. An endless belt or chain 39 may extend about pulley wheel 44 and also about pulley wheel 38 to fix first rotatable mechanism 46 to rotate with motor output shaft 36. Another endless belt or chain 51 may extend about pulley wheel 50 and also about pulley wheel 53 to fix second rotatable mechanism 46 to rotate with spool 52. It should be appreciated that descriptions herein of two elements "fixed to rotate" with one another should not be understood to mean that the two elements necessarily rotate at the same speed. Rather, "fixed to rotate" means that when one of the subject elements rotates, so does the other, with a constant relative rotational speed between the two. Thus, it will be readily appreciated that the various pulley wheels depicted in FIG. 1 and described herein may have different diameters, and thus rotate at different speeds even where fixed to rotate with one another via an endless belt, chain, etc.

Swimmer training apparatus 10 may further include a control system 200 adapted for controlling operation of the various components of swimmer training apparatus 10 during training a swimmer, as further described herein. Control system 200 may include an electronic control unit 202 having a data processor 204 and a computer readable memory 206. Control system 200 may be in control communication with motor 34, and also in control communication with torque transfer device 40. Control system 200 may thus turn on motor 34, turn off motor 34, etc. Control system 200 may likewise control an electrical energy state of torque transfer device 40 to control torque transfer between first rotatable mechanism 46 and second rotatable mechanism 48, as further described herein. Control system 200 may further be coupled with a power input interface 87 which is connected with an electrical plug 88. Power input interface 87 will typically include appropriate components such as power rectifiers, power inverters, etc., for powering the various components of swimmer training apparatus 10 from 110 VDC or 220 VDC power supplies. The components of power input interface 87 are conventional, and control of power input interface 87 to supply various levels of DC or AC current to components of swimmer training apparatus 10 will take place in a conventional manner. In one embodiment, each of motor 34 and torque transfer device 40 will be DC powered devices. Power input interface 87 may be coupled via appropriate electrical wiring connections with motor 34, torque transfer device 40 and any other electrically powered components of swimmer training apparatus 10. Such connections are deemed conventional, and thus are not specifically illustrated in FIG. 1.

Control system 200 may further include a sensing system 31 which includes a speed sensor 84. Speed sensor 84 may be coupled with a pulley wheel 86 driven via belt 51 and may be configured to output sensor signals to electronic control unit 202 which are indicative of a rotational speed of pulley wheel 86, and hence indicative of a rotational speed of spool 52. Suitable rotational speed sensors are well known and widely used. By way of known techniques, rotational speed of spool 52 may be used to compute linear speed of a swimmer during playing out or taking up swimmer tethering line 95, for reasons which will be apparent from the following description. Sensing system 31 may further include a distance sensor 80, such as a toothed wheel mechanism for example, coupled with spool shaft 60, rod 68 or any other suitable rotating part of apparatus 10. Distance sensor 80 enables electronic control unit 202 to count revolutions of spool 52, for example, and in turn compute a linear swimmer travel distance, again by way of known techniques. It should be appreciated that the speed and distance sensor mechanisms described herein are illustrative only, and those skilled in the art will appreciate that a variety of other techniques may be used for distance and/or speed sensing, such as optical scanning techniques, electromagnetically sensing magnets embedded in swimmer tethering line 95, or a variety of other strategies. Electronic control unit 202 may further be equipped with a timer or clock (not shown) for timing various swimmer training or evaluation routines, as further described herein. A power switch (not shown) may be mounted to housing 12 and configured to turn on power to swimmer training apparatus 10 from power input interface 87. In addition, a signaling device 32 such as a light having a plurality of illumination states may be mounted to housing 12 and controllably coupled with electronic control unit 202, as further described herein.

In one embodiment, control system 200 may be configured by way of software including computer readable code stored on computer readable memory 206 to operate, monitor and control each of motor 34 and torque transfer device 40, for executing a variety of swimmer training or evaluation routines, further described herein. It should be appreciated that the terms "training," "testing" and "evaluation" are used interchangeably herein, except as otherwise noted. Control system 200 may be resident on swimmer training apparatus 10. In other instances, and indeed in one practical implementation strategy, a non-resident computer such as a laptop computer may be connected with swimmer training apparatus 10 during swimmer training, and may actually control motor 34 and torque transfer device 40, as well as gather data from sensing system 31. Thus, while electronic control unit 202 is shown positioned within housing 10, in other embodiments electronic control unit 202 might be resident on a computer separate from apparatus 10. To this end, a communications link (not shown), such as a hardwired or wireless link, may be a component of control system 200 for connecting with a non-resident computer. For the sake of clarity and simplicity the present description assumes that electronic control unit 202 is preprogrammed with all of the software required to implement swimmer training routines as described herein, and is resident on apparatus 10.

Figure 2:
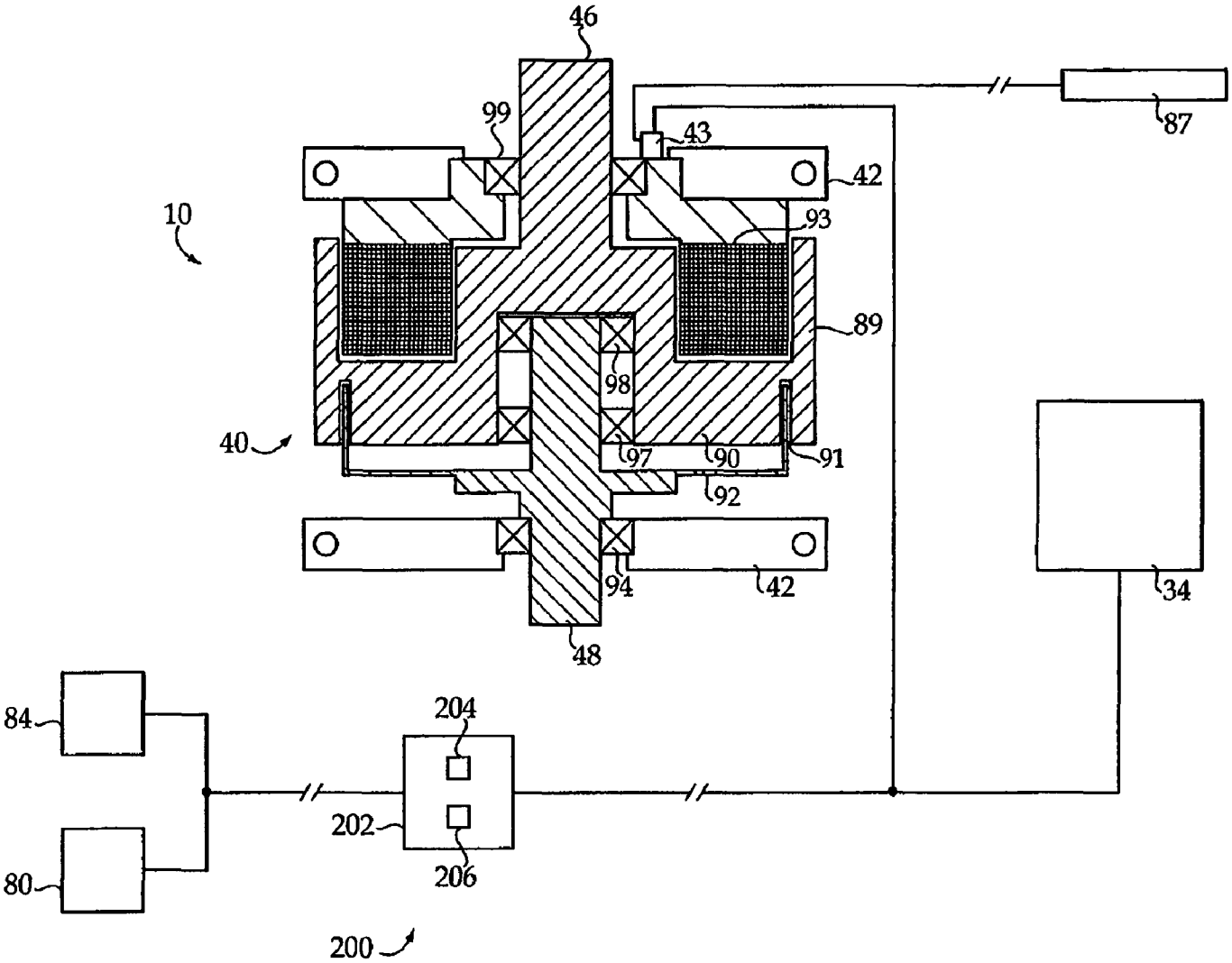
FIG. 2 is a partially sectioned diagrammatic view of a portion of the swimmer training apparatus of FIG. 1.

Referring also now to FIG. 2, there is shown a partially sectioned diagrammatic view of certain of the components which are used as a torque control system for swimmer training apparatus 10. Control system 200 and motor 34 are shown in block diagram form. Torque transfer device 40 is shown in a sectioned view. In one embodiment, torque transfer device 40 may be a bidirectional torque transfer device. To this end, torque transfer device 40 may be configured to apply an assistive torque from motor 34 on spool 52 when rotating spool 52 in a first direction, such as in a take-up mode, as further described herein. Torque transfer device 40 may further be configured to apply a resistive torque on spool 52 when rotating spool 52 in a second direction, such as in a play-out mode, also further described herein. One of first rotatable mechanism 46 and second rotatable mechanism 48 may include a magnetically permeable medium 92. Torque transfer device 40 may further include a magnetic field generator 93. Magnetically permeable medium 92 may be configured via interacting with a magnetic field generated via magnetic field generator 93 to transfer torque between first rotatable mechanism 46 and second rotatable mechanism 48.

In one embodiment, magnetic field generator 93 may include an electrically powered field coil configured to generate a magnetic field responsive to applying an electric current thereto. To this end, a control device 43 may be provided which connects with or is a part of electrical input interface 87 and is also controllably coupled with electronic control unit 202. Control device 43 may be used to control a magnitude of electric current to magnetic field generator 93, in turn controlling an intensity of the magnetic field generated thereby. Magnetic field intensity of the magnetic field will generally be positively correlated with a magnitude of the electrical current supplied to magnetic field generator 93.

It will be recalled that first rotatable mechanism 46 may be fixed to rotate with motor output shaft 36. To this end, first rotatable mechanism 46 may be rotatably journaled via a first bearing 99, a second bearing 98 and a third bearing 97. Second rotatable mechanism 48 may be fixed to rotate with spool 52. Second rotatable mechanism 48 may be rotatably journaled via second bearing 98 and also via third bearing 97, and each of second bearing 98 and third bearing 97 may contact each of first rotatable mechanism 46 and second rotatable mechanism 48. A fourth bearing 94 may rotatably journal second rotatable mechanism 48 in support block 42.

In one embodiment, first rotatable mechanism 46 may be positioned so that it does not contact second rotatable mechanism 48. First rotatable mechanism 46 may include a magnetic pole structure including an outer pole 89 and an inner pole 90, defining an air gap 91 therebetween. Second rotatable mechanism 48 may include a cup-shaped rotor which projects into air gap 91 and includes magnetically permeable medium 92 and is thus commonly identified therewith via reference numeral 92. In one embodiment, rotor 92 may include a solid metallic cup formed of a magnetically permeable metal such as iron, nickel or alloys thereof. During operation of torque transfer device 40, first rotatable mechanism 46 may receive an input torque from motor 34. An assistive torque may be transferred within torque transfer device 40 from first rotatable mechanism 46 to second rotatable mechanism 48, and thenceforth transferred to spool 52. This general mechanism of operation will apply where motor 34 is used to rotate spool 52 in a take-up mode, as further described herein. Where operating in a play-out mode, motor 34 may or may not rotate. Hence, first rotatable mechanism 46 may be stationary in a play-out mode, but could also be rotating in a direction opposite that of second rotatable mechanism 48. In a play-out mode, a swimmer may be unspooling swimmer tethering line 95 from spool 52 and, hence, applying a torque to second rotatable mechanism 48. In such instances, a resistive torque may be transferred within torque transfer device 40 from second rotatable mechanism 48 to first rotatable mechanism 46. The relative magnitude of torque transferred within torque transfer device 40 in either of a play-out mode or a take-up mode will relate to an intensity of the magnetic field generated by magnetic field generator 93.

It will be recalled that magnetically permeable medium 92 may be configured via interacting with the magnetic field generated by magnetic field generator 93 to transfer torque between first rotatable mechanism 46 and second rotatable mechanism 48. In one embodiment, torque transfer device 40 may define a positive electric current to bidirectional torque capacity correlation coefficient. For example, assume an input torque of "X" Newton-meters is applied from motor 34 to first rotatable mechanism 46 when an electric current of "Y" Amperes is supplied to magnetic field generator 93 at a supply voltage. This might be the case when apparatus 10 is operating in a take-up mode and applying an assistive force on a swimmer. A torque transferred to second rotatable mechanism 48 and thus applied to spool 52 for assisting taking up swimmer tethering line 95 will be the input torque of X Newton-meters multiplied by a first numeric value which is based on the magnitude of the electric current Y Amperes. When an input torque of X Newton-meters is applied to first rotatable mechanism 46 and an electric current of Y+1 Amperes is supplied to magnetic field generator 93 at the supply voltage, then a torque transferred to second rotatable mechanism 48 and thus applied to spool 52 for assisting taking up swimmer tethering line 95 will be the input torque of X Newton-meters multiplied by a second numeric value which is based on the magnitude of the electric current Y+1 Amperes. It will thus be appreciated that the capacity for transferring torque from first rotatable mechanism 46 to second rotatable mechanism 48 will be positively correlated with an intensity of the magnetic field generated by magnetic field generator 93, which is in turn positively correlated with a magnitude of the electric current supplied to magnetic field generator 93. The first numeric value and the second numeric value in the above examples represent the positive electric current to bi-directional torque capacity coefficient. In other words, the subject coefficient is a positive numerical quantity which varies as a function of electric current magnitude in magnetic field generator 93. In a play-out mode, where a torque is applied to second rotatable mechanism 48 as a swimmer is unspooling swimmer tethering line 95, rotor 92 may interact with a magnetic field of controllable intensity generated via magnetic field generator 93 to resist rotation of spool 52. Application of a resistive force thus takes place in a manner analogous to application of an assistive force. Where device 40 is used to resist rotation of spool 52, motor 34 may be stationary, or motor 34 may be rotating. In some instances, motor 34 might rotate continuously throughout both a play-out, resistive mode and a take-up, assistive mode. This capability may enhance a perceived smoothness in operation of apparatus 10, as it will be unnecessary to start or stop rotation of motor 34 during operation.

From the foregoing description, those skilled in the art will appreciate that torque transfer device 40 may operate as a clutch. In other words, relative rotation may exist between first rotatable mechanism 46 and second rotatable mechanism 48. At any given time, regardless of rotation direction, a magnitude of a torque transferred between first rotatable mechanism 46 and second rotatable mechanism 48 may be positively correlated with a magnitude of an electric current supplied to magnetic field generator 93. The torque capacity of torque transfer device 40 will be understood in light of the present description to be the magnitude of torque which can be transferred between first rotatable mechanism 46 and second rotatable mechanism 48 without relative rotation occurring between the respective components. Since torque transfer device 40 may be bidirectional, torque transfer device 40 will be understood to define the positive electric current to bi-directional torque capacity correlation coefficient mentioned above. Determining the subject coefficient may take place empirically, for example, by varying torque(s) applied to one or both of rotatable mechanisms 46 and 48, and varying electric current magnitude to magnetic field generator 93, and measuring a torque transferred between elements 46 and 48.

In one practical implementation strategy, torque transfer device 40 may include a hysteresis clutch. As used herein, the term "hysteresis" clutch should be understood to refer to a class of clutch mechanisms known in the art that enable torque transfer between two rotatable bodies based predominantly upon interaction of one of the rotatable bodies with a magnetic field of controllable intensity. Suitable hysteresis clutches are available from Magtrol Inc. of Buffalo, N.Y. Other devices might be substituted for a hysteresis clutch without departing from the scope of the present disclosure. Devices are known, for example, which transfer torque between two rotatable bodies by way of inducing electrical eddy currents in one of the rotatable bodies. Embodiments are contemplated where an eddy current device is used, however, a hysteresis device as described herein is contemplated to be one practical implementation strategy, as hysteresis clutches tend to provide a smoothly controllable, robust mechanism for transferring torque. In still other embodiments, more exotic variable torque transfer devices such as those using electro-rheological fluids and the like might be substituted for torque transfer device 40. Certain permanent magnet clutch devices where torque transfer between two bodies is based on proximity or positioning of a magnetically permeable medium to a permanent magnet could also be used. In still other versions, combinations of multiple clutches or combinations of clutches with brakes might be used which would still fairly be considered to fall within the spirit and scope of the present disclosure.

INDUSTRIAL APPLICABILITY

Figure 3:
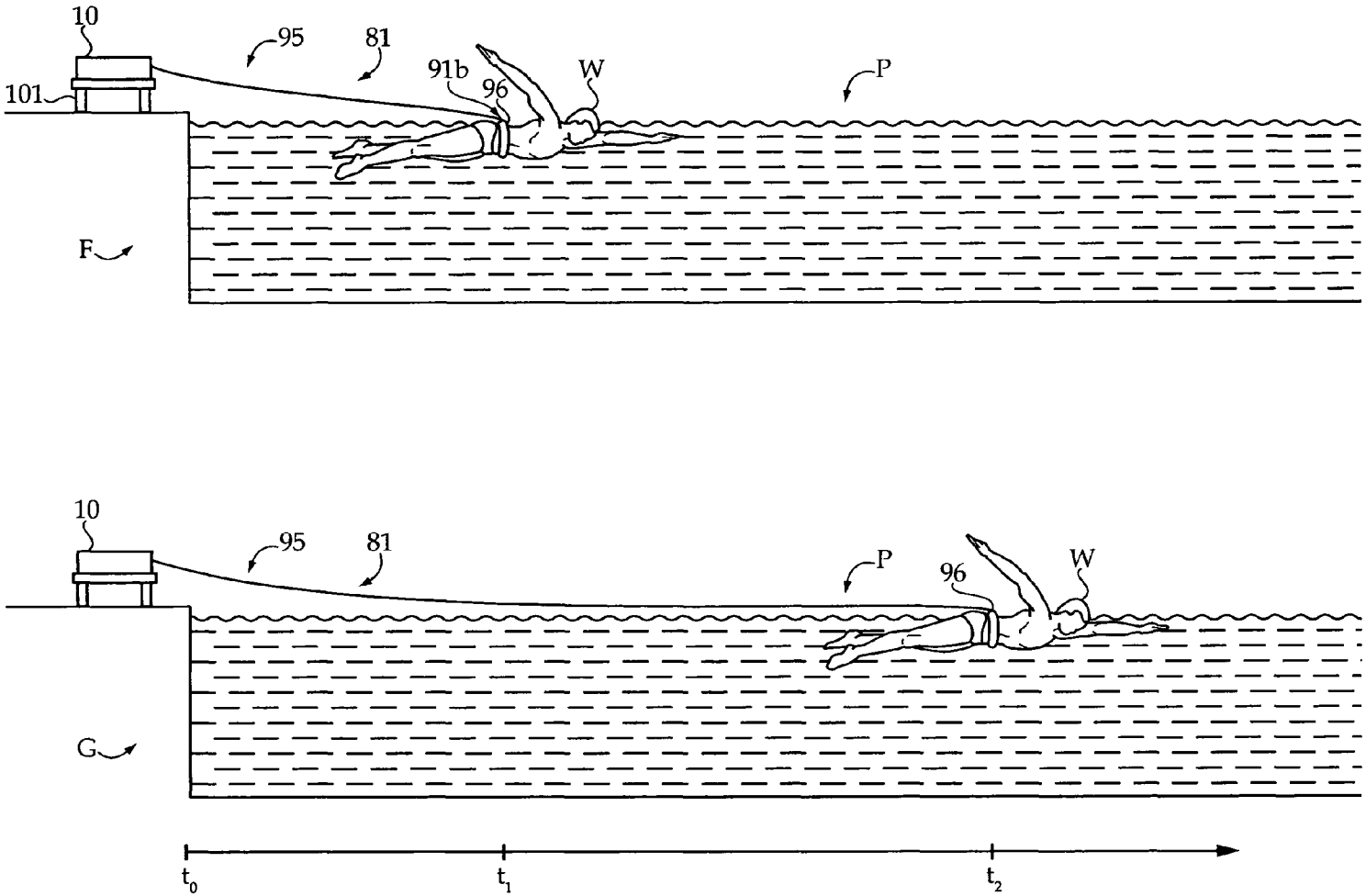
FIG. 3 is a diagrammatic illustration in two views of a swimmer training apparatus mounted in a use position adjacent a swimming pool, according to one embodiment.

Referring to FIG. 3, there is shown an illustration of swimmer training apparatus 10 mounted in a use position/orientation adjacent an edge of a swimming pool "P". In one embodiment, swimmer training apparatus 10 may be positioned upon and secured to a starting block 101. A human swimmer is identified via reference letter W. A swimmer tethering mechanism 81 which includes swimmer tethering line 95 and a swimmer tethering harness 96 are also shown. A second end 91*b* of swimmer tethering line 95 connects with swimmer tethering harness 96, whereas a first end 91*a* shown in FIG. 1 connects with rotatable spool 52. It should be appreciated that the illustration in FIG. 3 is diagrammatic only, and additional components of a swimmer training system such as a directional pulley wheel for directing swimmer tethering line 95 along a surface of pool P as desired might be used. Moreover, personnel involved in training a swimmer such as a trainer might utilize a laptop computer coupled with swimmer training apparatus 10, although no such computer is illustrated in FIG. 3.

Figure 5:
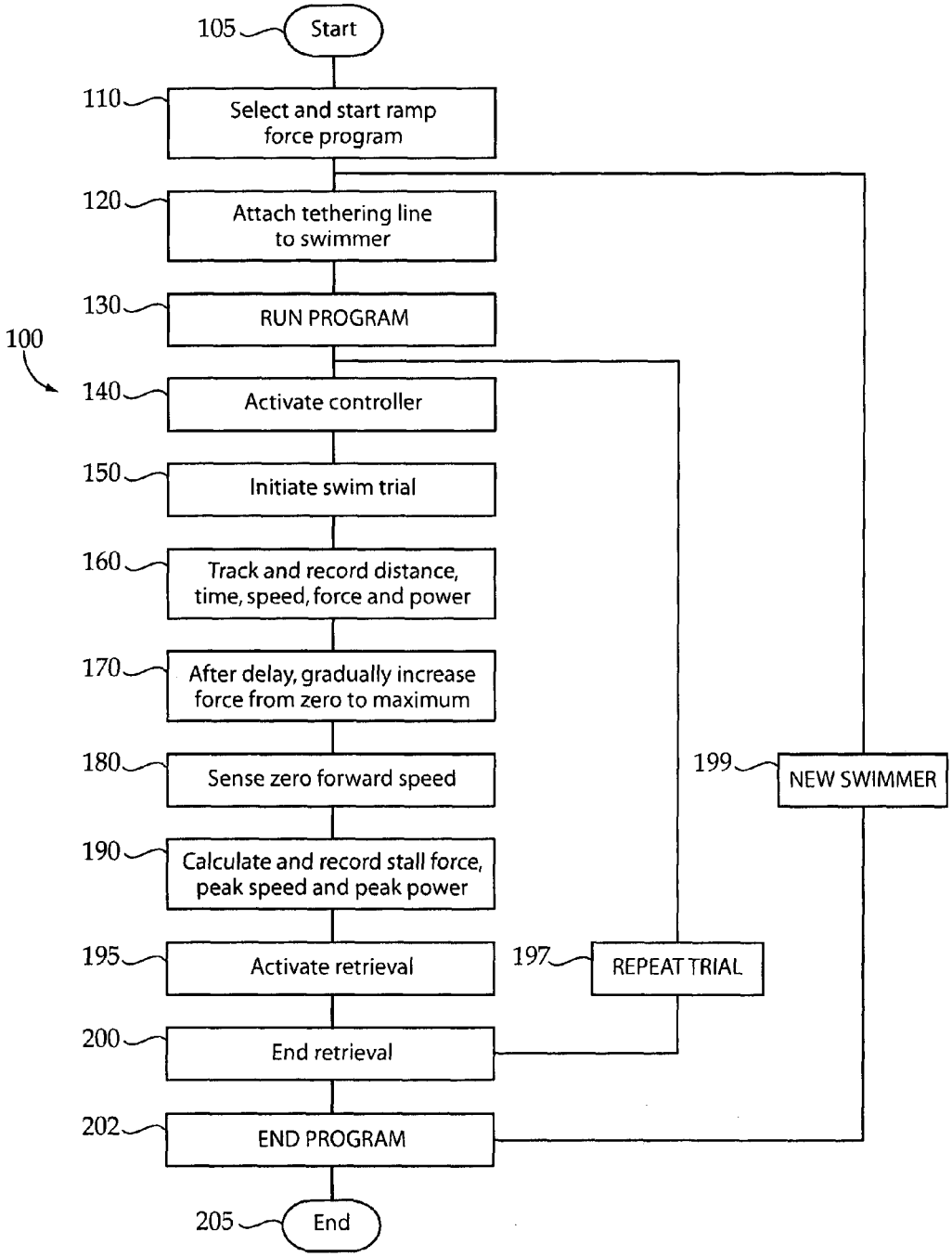
FIG. 5 is a flowchart illustrating an example training/testing routine, according to one embodiment.

In FIG. 3, the upper illustration "F" shows swimmer W after having unspooled an initial segment of swimmer tethering line 95 between a start time to of a training or evaluation cycle and a second time $t_1$. The lower illustration "G" shows swimmer W after having unspooled a subsequent segment of swimmer tethering line 95 between time $t_1$ and a third time $t_2$. Referring also to FIG. 5, there is shown a flowchart 100 illustrating an example control routine whereby swimmer training apparatus 10 is used in training/evaluating a swimmer and gathering various test data respecting the swimmer's performance.

The process of flowchart 100 may start at step 105, and may thenceforth proceed to step 110 to select and start a ramp force program. The ramp force program may generally involve increasing a resistive force on a swimmer as the swimmer swims in a pool until such time as the swimmer is no longer able to make forward progress due to the resistive force. The ramp force program may be only one of a plurality of programs available for implementation via swimmer training apparatus 10, certain of which are further described below. From step 110, the process may proceed to step 120 to attach tethering line 95 to swimmer W. From step 120, the process may proceed to step 130 to run the selected program.

From step 130, the process may proceed to step 140 to activate the controller, such as electronic control unit 202, and thenceforth to step 150 to initiate a swim trial. In one embodiment, a signaling device such as device 32 may be activated to signal to a swimmer to begin swimming and/or alternatively signal a trainer to verbally command a swimmer to begin swimming, such as by pushing off from an edge of pool P. In executing the example ramp force program, resistive force applied to a swimmer may be maintained at a constant, relatively low level or a zero level for an initial period of the program. It is only after a swimmer has traveled a specified distance, or after a specified time, that force ramping will typically commence.

FIG. 3 shows in illustration F an example initial distance traveled by swimmer W, after which force ramping will commence. The specified distance (or time) may be selected to allow a swimmer to achieve a maximum or optimum speed for ramp force training, achieve a certain stroke cadence, or for other purposes. In any event, however, the specified distance or time might vary swimmer to swimmer, and/or might be determined empirically as an appropriate point to begin force ramping. At step 160, tracking and recording of distance, time, speed, force and power may commence. It will be recalled that electronic control unit 202 may include a timer. In addition, control system 200 may include speed sensor 84 and distance sensor 80, for monitoring a swimmer speed parameter and a swimming distance parameter. Computer readable memory 204 may store a value corresponding to the specified distance or time. To determine whether a tracked distance or time is equal to, or greater than, a specified distance or time, electronic control unit 202 may compare a value corresponding to a tracked distance or time with the value corresponding to the specified distance or time. After a specified time delay, for example, resistive force on swimmer W may be gradually increased from zero to or toward maximum resistive force in step 170.

In the present example routine, swimmer W is swimming away from apparatus 10, and will be understood to be unspooling swimmer tethering line 95 from spool 52. Motor 34 may be rotating or may not be rotating, and swimmer W will be applying a torque on spool 52 which is transferred to second rotatable mechanism 48. Where no electric current is supplied to magnetic field generator 93, substantially the only forces from apparatus 10 which resist forward travel by swimmer W will be relatively small frictional forces associated with rotating the various components of apparatus 10. Hence at step 170, force may be applied and incrementally increased. This means that a resistive force applied to swimmer W may be increased by changing an electrical energy state of a torque control mechanism of torque transfer device 40. In one embodiment, the torque control mechanism may include magnetic field generator 93. Changing an electrical energy state of torque transfer device 40 could include stepping up electrical current supplied to magnetic field generator 93 from zero to a first current level. Changing an electrical energy state of torque transfer device 40 could also include stepping up electrical current supplied to magnetic field generator 93 from a first current level to a second current level. In either case, changing the electrical energy state of magnetic field generator 93 increases a resistive torque applied to second rotatable mechanism 48 from first rotatable mechanism 46. By way of transferring the resistive torque to spool 52, resistive linear force applied to swimmer W via swimmer tethering line 95 is increased.

From step 170, the process may proceed to step 180 to sense a zero forward speed, for example based on inputs from speed sensor 84. Once speed is equal to zero, it may be concluded that swimmer W is no longer traveling forward, and cannot overcome the resistive linear force applied via swimmer tethering line 95. From step 180, the process may proceed to step 190 to calculate and record stall force, peak speed and peak power. By measuring speed and force as described herein, power and peak power may be calculated. Calculating peak power may take place by way of known techniques by measuring the maximum resistive force just prior to where a swimmer ceases to make forward progress. Step 190 may also include outputting a peak power signal. Outputting the peak power signal may include outputting a signal corresponding to the calculated peak power from data processor 202, and recording a signal value for the peak power signal on computer readable memory 204. Test data including distance traveled by swimmer W, time duration between $t_0$ and $t_2$, the stall force such as the maximum force applied via swimmer tethering line 95, and the peak power in watts, as well as other data may be recorded on computer readable memory at step 190. From step 190, the process may proceed to step 195 to activate retrieval of swimmer W. The process may then proceed to step 200 and end retrieval. If the routine is to be repeated, the process may proceed to step 197, then return to step 140. If the routine is not to be repeated, the process may proceed to end the program at step 202. The process may end at step 205, or may repeat via step 199 with a new swimmer, as illustrated.

Figure 4:
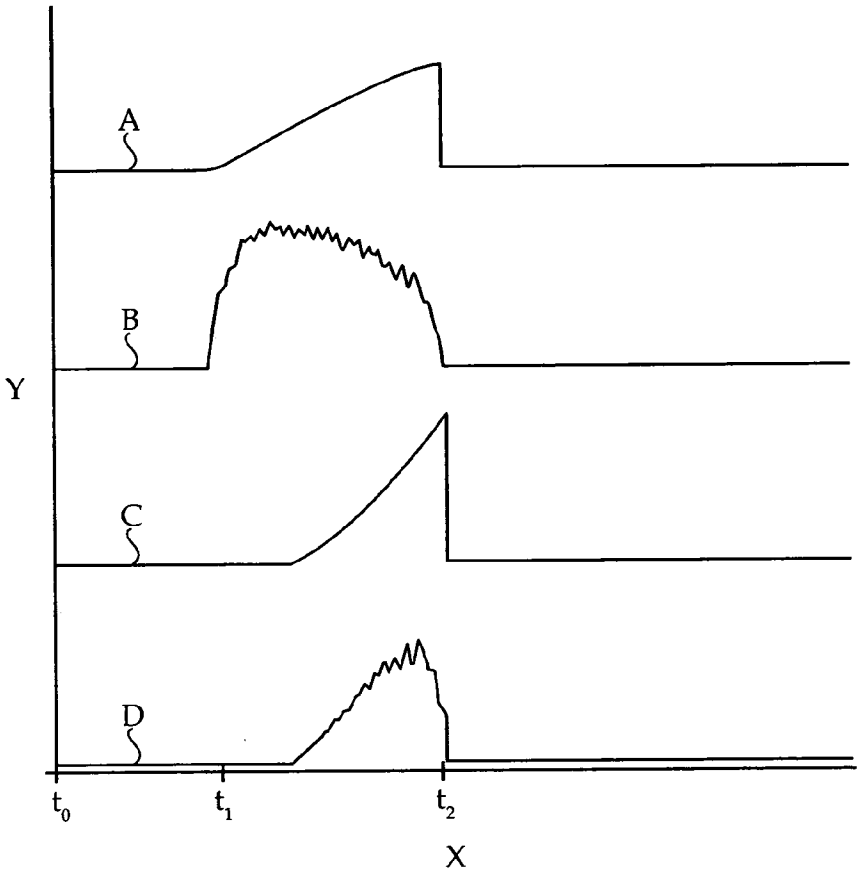
FIG. 4 is a graph illustrating signal values over time during an example training/testing routine for a swimmer, according to one embodiment.

Referring to FIG. 4, there is shown a graph illustrating a plurality of curves corresponding to data gathered during executing the routine described in connection with FIGS. 3 and 5 from time $t_0$ to time $t_2$. In FIG. 4, curve A corresponds to distance traveled by swimmer W. Curve B corresponds to speed of swimmer W. It may be noted that curve B is roughly sinusoidal, corresponding to variations in speed of a typical swimmer which arise from the swimmer's stroke cadence. Curve C corresponds to force applied via swimmer training apparatus 10. It may be noted that force steadily increases approximately from time $t_1$ to time $t_2$. Curve D represents power, and indicates a peak power output of swimmer W just prior to time $t_2$ at which the swimmer's speed drops to zero, indicating that forward progress has ceased. It may be noted that determining when a peak power output of swimmer W occurs may be based on both the speed of swimmer W and the resistive force applied to swimmer W. In other words, peak power output will typically exist just before the speed of swimmer W drops to zero.

During operation of swimmer training apparatus, data processor 204 may be determining values such as control command values for torque transfer device 40 which are indicative of resistive force applied to swimmer W. In other words, resistive force on swimmer W may be determined based on a known relationship between electrical current commands for magnetic field generator 93 and a torque transferred from first rotatable mechanism 46 to second rotatable mechanism 48. Such a relationship might be determined empirically. Where peak power is being determined, determining one or more values indicative of resistive force applied to swimmer W may take place during unspooling the second segment of swimmer tethering line 95 from time $t_1$ to $t_2$. Data processor 204 may also be determining values indicative of a speed of swimmer W, such as via inputs from sensor 84 which represent a rotational speed of spool 52 during unspooling swimmer tethering line 95. Where peak power is being determined, determining one or more values indicative of a speed of swimmer W may therefore also take place during unspooling the second segment of swimmer tethering line 95 from time $t_1$ to $t_2$. Thus, determining peak power output of swimmer W and outputting the peak power signal may be understood as taking place in a manner which is responsive to values indicative of a speed of a swimmer, and also responsive to values indicative of resistive torque on spool 52 and thus a resistive linear force on the swimmer.

As discussed above, the example routine described in connection with FIG. 3 is a ramp force program. Swimmer training apparatus 10 may be used in a variety of other types of programs, including but not limited to a resistance training swimming program, an assistance training swimming program or a resistance and assistance training swimming program. In the first of these, a resistance training mode, swimmer training apparatus 10 may be operated in a manner similar to that of the ramp force program. Rather than ramping force up until a swimmer stalls, however, a constant or varying resistive force can be applied during playing out swimmer tethering line 85 via controlling torque transfer device 40 as described herein. The smoothly controllable resistive force applied via torque transfer device 40 may allow force to be varied in some embodiments based on a swimmer's stroke cadence. For example, resistive force could be increased and decreased in opposition to a swimmer's increasing and decreasing swimming force which occurs as the swimmer strokes through the water. In an assistance training mode, motor 34 may be used to assist a swimmer by providing an assistive torque during taking up swimmer tethering line 95. The assistive torque may also be varied by way of controlling torque transfer device 40 as described herein. In a resistance and assistance training mode, a resistive torque may be applied while a swimmer is unspooling swimmer tethering line 95, and then an assistive torque may be applied while motor 34 is activated to take up or spool swimmer tethering line 95.

It should be appreciated that in any of the modes described herein, torque may be applied to spool 52 via controlling torque transfer device 40 as described herein. A first torque may be applied during unspooling a first segment of swimmer tethering line 95, and then increased or decreased during unspooling a second segment of swimmer tethering line 95. Thus, by way of the illustrations of FIG. 3, it will be understood that a first torque corresponding to a first resistive force might be applied from time $t_0$ to $t_1$, whereas a second, greater or lesser torque, corresponding to a second, different resistive force might be applied from time $t_1$ to $t_2$. Similarly, when a swimmer turns around and begins swimming back toward apparatus 10, a first assistive force might be applied during taking up or spooling a first segment of swimmer tethering line 95, whereas a second, greater or lesser, assistive force might be applied during taking up or spooling a second segment of swimmer tethering line 95. During taking up or spooling swimmer tethering line 95, motor 34 may be operated at a constant speed.

The present disclosure differs from state of the art swimmer training systems and strategies where torque control is limited generally to braking rotating components of the system. Moreover, while certain systems might claim to control force on a swimmer, true force control in known systems is often limited to controlling a force applied during taking up a swimmer tethering line, and takes place only by way of attempting to control a force applied via a take-up motor. By using a torque transfer device as described herein, torque control and, hence, application of force on a swimmer tethering line is smoothly controllable during either of taking up or playing out a swimmer tethering line. During taking up or playing out a swimmer tethering line, motor 34 may operate at constant speed, with force control taking place purely by way of controlling torque transfer device 40. These attributes of apparatus 10 are considered to provide various advantages over state of the art systems. Apparatus 10 not only enables training routines that are otherwise possible, if at all, only by way of complex, expensive and unwieldy mechanisms, but also enables obtaining test data for a swimmer such as peak power that are not possible with conventional systems.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

I claim:

1. A swimmer training apparatus comprising:

a housing;

a rotatable spool mounted to the housing and defining a longitudinal spool axis, the rotatable spool having a cylindrical outer spool surface and being configured via rotating in a first direction or a second direction opposed to the first direction for respectively playing out or taking up a swimmer tethering line;

a spooler mounted to the housing and adapted to axially advance a swimmer tethering line along the cylindrical outer spool surface during playing out or taking up the swimmer tethering line;

a motor mounted within the housing and including a motor output shaft; and a torque transfer device coupled between the motor output shaft and the rotatable spool and including a magnetic field generator configured to generate a magnetic field, a first rotatable mechanism fixed to rotate with the motor output shaft and a second rotatable mechanism fixed to rotate with the rotatable spool, one of the first rotatable mechanism and the second rotatable mechanism including a magnetically permeable medium adapted, via interacting with a magnetic field generated by the magnetic field generator, to transfer a torque between the first rotatable mechanism and the second rotatable mechanism during rotating the rotatable spool.

2. The swimmer training apparatus of claim 1 wherein the first rotatable mechanism does not directly contact the second rotatable mechanism, and wherein the torque transfer device provides bi-directional torque transfer where the magnetically permeable medium is adapted via interacting with the magnetic field to apply a resistive torque to the rotatable spool during rotating the rotatable spool in the first direction or an assistive torque during rotating the rotatable spool in the second direction.

3. The swimmer training apparatus of claim 2 wherein the magnetic field generator includes an electrically powered magnetic field coil configured to generate the magnetic field responsive to an electric current applied to the magnetic field coil, and wherein a magnitude of a torque transferred between the first and second rotatable mechanisms is positively correlated with a magnitude of the electric current.

4. The swimmer training apparatus of claim 2 wherein the motor includes an electric motor defining a longitudinal motor axis, wherein the torque transfer device defines a longitudinal torque transfer device axis and wherein the longitudinal motor axis, the longitudinal torque transfer device axis and the longitudinal spool axis are each parallel and non-colinear with one another.

5. The swimmer training apparatus of claim 4 wherein the rotatable spool is positioned within the housing.

6. The swimmer training apparatus of claim 4 wherein the housing further includes a bottom housing panel defining a horizontal plane, a back housing panel and a front housing panel, the front housing panel having a generally vertical orientation relative to the horizontal plane and defining a feed opening positioned adjacent the spooler and adapted for feeding the swimmer tethering line to or from the rotatable spool during taking up or playing out the swimmer tethering line.

7. The swimmer training apparatus of claim 2 wherein the first rotatable mechanism includes a pole structure having an inner pole and an outer pole defining an air gap therebetween, wherein the second rotatable mechanism comprises a rotor which includes the magnetically permeable medium, and wherein the rotor includes a solid magnetically permeable metallic cup projecting into the air gap.

8. The swimmer training apparatus of claim 2 wherein the torque transfer device performs as a clutch.

9. The swimmer training apparatus of claim 8 wherein the torque transfer device performs as a hysteresis clutch.

10. The swimmer training apparatus of claim 9 wherein the first rotatable mechanism is fixed to rotate with the motor output shaft via a first endless belt and the second rotatable mechanism is fixed to rotate with the spool via a second endless belt.

11. A method of operating a swimmer training apparatus comprising:

applying a first torque to a rotatable spool of the swimmer training apparatus via a torque transfer device having a first rotatable mechanism fixed to rotate with a motor and a second rotatable mechanism fixed to rotate with the rotatable spool, the rotatable spool being configured for playing out or taking up a swimmer tethering line via spooling or unspooling the swimmer tethering line on a cylindrical outer spool surface of the rotational spool;

changing an electrical energy state of a torque control mechanism of the torque transfer device; and applying a second torque different from the first torque to the rotatable spool in response to a change in the electrical energy state of the torque control mechanism.

12. The method of claim 11 wherein the torque transfer device performs as a clutch, the first rotatable mechanism includes a field coil configured to generate a magnetic field and the second rotatable mechanism includes a rotor having a magnetically permeable medium configured via interacting with the magnetic field to transfer a torque between the first rotatable mechanism and the second rotatable mechanism during rotation of the rotatable spool, and wherein changing an electrical energy state of the torque transfer device further includes changing an electrical energy state of the field coil.

13. The method of claim 12 further comprising unspooling a swimmer tethering line from the cylindrical outer spool surface of the rotatable spool, and wherein at least one of applying a first torque to the rotatable spool and applying a second torque to the rotatable spool includes applying a resistive torque during unspooling of the swimmer tethering line.

14. The method of claim 13 wherein applying a first torque further includes applying a relatively lesser resistive torque during unspooling a first segment of the swimmer tethering line and wherein applying a second torque further includes applying a relatively greater resistive torque during unspooling a second segment of the swimmer tethering line.

15. The method of claim 14 further comprising:

determining a first value indicative of a rotational speed of the rotatable spool during unspooling the second segment of the swimmer tethering line;

determining a second value indicative of a resistive torque applied to the rotatable spool during unspooling the second segment of the swimmer tethering line; and outputting a peak power signal responsive to the first value and the second value.

16. The method of claim 15 further comprising spooling a swimmer tethering line onto the cylindrical outer surface of the rotatable spool, and wherein each of applying a first torque to the rotatable spool and applying a second torque to the rotatable spool further include applying an assistive torque during spooling the swimmer tethering line.

17. A torque control system for a swimmer training apparatus comprising:

a torque transfer device including an electrically powered magnetic field generator configured to generate a magnetic field, a first rotatable mechanism configured to couple with a motor output shaft of a motor and a second rotatable mechanism configured to couple with a rotatable spool adapted for playing out or taking up a swimmer tethering line, one of the first rotatable mechanism and the second rotatable mechanism including a magnetically permeable medium adapted via interacting with the magnetic field to transfer torque between the first rotatable mechanism and the second rotatable mechanism during rotating the rotatable spool;

a sensing system including a sensor configured to monitor at least one of, a swimming distance parameter or a swimming speed parameter, during playing out or taking up the swimmer tethering line via rotating the rotatable spool; and a control system for controlling torque transfer between the first rotatable mechanism and the second rotatable mechanism during playing out or taking up the swimmer tethering line, the control system including an electronic control unit coupled with the sensing system and in control communication with the magnetic field generator;

wherein the electronic control unit is configured to vary a torque transfer between the first rotatable mechanism and the second rotatable mechanism at least in part via controlling an intensity of the magnetic field responsive to inputs from the sensing system.

18. The torque control system of claim 17 wherein the torque transfer device performs as a hysteresis clutch.

* * * * *